US006425955B1

(12) United States Patent
Hacias et al.

(10) Patent No.: US 6,425,955 B1
(45) Date of Patent: Jul. 30, 2002

(54) PROCESS FOR AVOIDING FOAMING DURING CLEANING OF METAL SALTS OF INTERMEDIATE LENGTH CARBOXYLIC ACIDS FROM SURFACES

(75) Inventors: Kenneth J. Hacias, Sterling Hts.; Richard J. Church, Berkley, both of MI (US)

(73) Assignee: Henkel Corporation, Gulph Mills, PA (US)

( * ) Notice: Subject to any disclaimer, the term of this patent is extended or adjusted under 35 U.S.C. 154(b) by 0 days.

(21) Appl. No.: 09/530,244

(22) PCT Filed: Nov. 3, 1998

(86) PCT No.: PCT/US98/23211

§ 371 (c)(1),
(2), (4) Date: Apr. 26, 2000

(87) PCT Pub. No.: WO99/23193

PCT Pub. Date: May 14, 1999

Related U.S. Application Data

(60) Provisional application No. 60/064,242, filed on Nov. 4, 1997.

(51) Int. Cl.[7] ..... C23G 1/14

(52) U.S. Cl. ..... 134/2; 134/10; 134/13; 134/26; 134/29; 510/248; 510/252

(58) Field of Search ..... 134/2, 10, 13, 134/26, 29; 510/248, 252

(56) References Cited

U.S. PATENT DOCUMENTS

| | | | | | |
|---|---|---|---|---|---|
| 3,607,482 | A | * | 9/1971 | Selm | 156/19 |
| 4,436,643 | A | * | 3/1984 | Burger et al. | 252/135 |
| 5,250,230 | A | * | 10/1993 | Steele et al. | 252/544 |
| 5,317,841 | A | * | 6/1994 | Cook et al. | 51/321 |
| 5,433,885 | A | * | 7/1995 | Winston et al. | 252/174.24 |
| 5,520,841 | A | * | 5/1996 | Block et al. | 252/174.23 |

FOREIGN PATENT DOCUMENTS

| | | | |
|---|---|---|---|
| WO | WO99/23193 | * | 5/1999 |
| WO | WO99/24534 | * | 5/1999 |
| WO | WO01-26792a2 | * | 4/2001 |

* cited by examiner

*Primary Examiner*—Sharidan Carrillo
(74) *Attorney, Agent, or Firm*—Stephen D. Harper; Daniel S. Ortiz

(57) ABSTRACT

Aqueous alkaline cleaning solutions are used to remove metal intermediate length carboxylate salts from a solid substrate. Foaming of the aqueous alkaline cleaning solution can be adequately reduced by treating the anions of the metal intermediate length carboxylate salts with cations. The anions of the metal intermediate length carboxylate salts constitute a separate solid phase layer that be readily separated from the cleaning solution, resulting in a regenerated aqueous alkaline cleaning solution.

12 Claims, No Drawings

PROCESS FOR AVOIDING FOAMING DURING CLEANING OF METAL SALTS OF INTERMEDIATE LENGTH CARBOXYLIC ACIDS FROM SURFACES

This application claims the benefit of provisional application No. 60/064,242 filed Nov. 4, 1997.

BACKGROUND OF THE INVENTION

This invention relates to management of a cleaning process that removes metal salts of intermediate length carboxylic acids, i.e., fatty acids with from 10 to 22 carbon atoms per molecule, from surfaces where such salts are present over an underlying solid, water resistant substrate, particularly a metal substrate. The remainder of this description will be in terms of metal substrates, but it should be understood that the invention is equally applicable, mutatis mutandis, to cleaning from any solid substrate that is not damaged by contact with water and the other constituents of the cleaning compositions described below. The metal substrate may or may not have other surface layers such as phosphate conversion coatings; anodized coatings; complex oxide layers such as those that can be formed with a commercially available product named BONDERITE® 770X from the Henkel Surface Technologies Div. of Henkel Corp., Madison Heights, Mich.; or the like underlying the coating of metal intermediate length carboxylate salt(s). Such metal salts, particularly water-insoluble ones, are widely used as lubricants for cold drawing of steel and other metals, usually over a phosphate or other conversion coating that is believed to act as a "carrier" for the lubricative metal intermediate length carboxylate salt(s). After cold drawing has been completed, in most instances the metal intermediate length carboxylate salt(s) and any underlying conversion coating need to be removed before further processing of the metal article that has been cold drawn.

Such removal/cleaning has been conventionally accomplished with strongly alkaline cleaners, preferably also containing sequestering agents for the metal cations in any underlying conversion coating, when such a coating is present, and surfactants to aid in wetting of the surface and dispersion and removal of soils. However, when substantial amounts of metal intermediate length carboxylate salt(s) have been dissolved in such a cleaner, it becomes strongly prone to foaming, which causes practical difficulties in processing. Up to now, surfactant anti-foam agents have been primarily used to control such foaming, but their success leaves much to be desired in many practical operations: Even if foaming is effectively prevented, as is by no means always accomplished, solid residues on various parts of the process equipment tend to accumulate with continued use of a fixed volume of cleaner. Accordingly, a major object of this invention is to provide a method of avoiding impractical amounts of foaming during cleaning of metal intermediate length carboxylate salt(s) from underlying metal substrates, thereby achieving cleaning results that are more economical, more consistent in cleaning quality, or both. Other objects will be apparent from the description below.

Except in the claims and the operating examples, or where otherwise expressly indicated, all numerical quantities in this description indicating amounts of material or conditions of reaction and/or use are to be understood as modified by the word "about" in describing the broadest scope of the invention. Practice within the numerical limits stated is generally preferred, however. Also, throughout the description, unless expressly stated to the contrary: percent, "parts of", and ratio values are by weight or mass; the term "polymer" includes "oligomer", "copolymer", "terpolymer" and the like; the description of a group or class of materials as suitable or preferred for a given purpose in connection with the invention implies that mixtures of any two or more of the members of the group or class are equally suitable or preferred; description of constituents in chemical terms refers to the constituents at the time of addition to any combination specified in the description or of generation in situ within the composition by chemical reaction(s) noted in the specification between one or more newly added constituents and one or more constituents already present in the composition when the other constituents are added, and does not necessarily preclude unspecified chemical interactions among the constituents of a mixture once mixed; specification of constituents in ionic form additionally implies the presence of sufficient counterions to produce electrical neutrality for the composition as a whole and for any substance added to the composition; any counterions thus implicitly specified preferably are selected from among other constituents explicitly specified in ionic form, to the extent possible; otherwise such counterions may be freely selected, except for avoiding counterions that act adversely to an object of the invention; the word "mole" means "gram mole", and the word itself and all of its grammatical variations may by used for any chemical species defined by all of the types and numbers of atoms present in it, irrespective of whether the species is ionic, neutral, unstable, hypothetical, or in fact a stable neutral substance with well defined molecules; and the terms "solution", "soluble", "homogeneous", and the like are to be understood as including not only true equilibrium solutions or homogeneity but also dispersions that show no visually detectable tendency toward phase separation over a period of observation of at least 100, or preferably at least 1000, hours during which the material is mechanically undisturbed and the temperature of the material is maintained within the range of 18–25° C.

BRIEF SUMMARY OF THE INVENTION

It has been found that at least the major object of the invention as stated above can be achieved by an essentially different means from the use of antifoam agents as the only aid to foam control: The intermediate length carboxylate anion(s), which have been found to be the major cause of the foaming tendency exhibited by an aqueous liquid alkaline cleaning composition containing them, are precipitated by addition of appropriate cations (for example, Ca, Mg, or Ba) that will form, together with the already present intermediate length carboxylate anions, salts that are substantially insoluble in the alkaline cleaning composition. The precipitated salts can be removed from the used aqueous liquid alkaline cleaning composition by filtration, by allowing the precipitated salts to settle as a sludge and then draining the sludge from the bottom of a holding tank, by skimming any floating precipitate off a holding tank for the circulating cleaning composition, and/or by any other suitable method for separating solids from liquids, many of which are known to those skilled in the art. After the intermediate length carboxylate anions have been thus removed from the cleaning composition, the composition can be re-used indefinitely, without any foaming problems, as long as any ingredients consumed during use are replenished and any subsequent accumulations of intermediate length carboxylate anions in the composition are removed when needed by repetition of the removal steps described above. In most instances, no specific anti-foam agent at all needs to be used in the aqueous liquid alkaline cleaning composition when intermediate length carboxylate anions are removed from the composition whenever the concentration of these anions exceeds a selected value, although a small amount of anti-foam agent may be useful in some instances. Thus the cost of anti-foam agents is avoided or at least very much reduced.

A clean surface suitable for immediate further processing of the cold-drawn metal substrate can normally be achieved, after the cleaning as described above, by rinsing any residue of cleaning solution from the cleaned substrates in sufficiently hot water to cause the substrate to flash dry by evaporation after rinsing.

DETAILED DESCRIPTION OF THE INVENTION

At a minimum, a process according to the invention for cleaning an article having a solid surface that includes metal intermediate length carboxylate salt(s) and an underlying metal substrate preferably comprises, more preferably consists essentially of, or still more preferably consists of, the following steps:

(I) providing a fixed volume of an aqueous liquid alkaline cleaning composition that is capable of dissolving said metal intermediate length carboxylate salt(s);

(II) contacting the aqueous liquid alkaline cleaning composition that is provided in step (I) with the surface of the article to be cleaned that includes said metal intermediate length carboxylate salt(s) for a sufficient time that at least a part of said metal intermediate length carboxylate salt(s) is transferred from said solid surface to solution in said aqueous liquid alkaline cleaning composition, thereby converting it to a used aqueous liquid alkaline cleaning composition and converting said article to be cleaned to a cleaned and at least initially wet solid article;

(III) adding to at least part of said used aqueous liquid alkaline cleaning composition precipitating cations that will cause, within a time of not more than one hour after said adding of precipitating cations, a solid phase that comprises at least part of said precipitating cations and at least part of the metal intermediate length carboxylate anions present in said part of said used aqueous liquid alkaline cleaning composition to separate from said used aqueous liquid alkaline cleaning composition, thereby converting the used aqueous liquid alkaline cleaning composition into a regenerated aqueous liquid alkaline cleaning composition; and, optionally, one or more of the following steps:

(IV') contacting the regenerated aqueous liquid alkaline cleaning composition that is provided in step (III) with a second solid surface to be cleaned, said second solid surface comprising said metal intermediate length carboxylate salt(s) that said regenerated aqueous liquid alkaline cleaning composition is capable of dissolving, for a sufficient time that at least a part of said type of metal intermediate length carboxylate salt(s) is transferred from said solid surface to solution in said regenerated aqueous liquid alkaline cleaning composition, thereby converting it to a once re-used aqueous liquid alkaline cleaning composition; and (IV") rinsing from the surface of the cleaned article provided at the end of step (II) any residue of said aqueous liquid alkaline cleaning composition that remains in contact with the cleaned article and drying the surface to provide a cleaned dry article.

If step (IV') as described above is included, the once re-used aqueous liquid alkaline cleaning composition generated in it may be used in a repetition of step (III) as described above, and this sequence may be repeated as many times as desired. Other steps that are conventional in themselves, such as prior cold working, application of the metal intermediate length carboxylate salt(s) lubricant to the substrate article prior to cold working, rinses, recovery and recycling of the metal intermediate length carboxylate anions from precipitate, and the like may be incorporated into a process according to this invention that includes the above minimum steps.

Before or as part of step (III) as described above, the part of the used aqueous liquid alkaline cleaning composition to be treated normally is preferably transferred to a location where none of the transferred part of the used aqueous liquid alkaline cleaning composition is in contact with said solid surface to be cleaned, in order to avoid any danger of precipitating metal intermediate length carboxylate salt(s) onto the otherwise cleaned surface. Such transfer is readily accomplished by a conventional circulation loop as used for spray cleaning, in which used cleaning composition runs more or less continuously off of the substrate(s) being cleaned into a collector from which it is pumped back eventually to the spray nozzles. A holding tank is often already present in such a circulation loop, or can readily be introduced if not already present, so that the addition of precipitating cations can be accomplished by additions to the holding tank. Many alternative mechanical arrangements for accomplishing the same purpose will be apparent to those skilled in the art.

Experience may show in some instances that the precipitate formed does not tend to stick to cleaned metal surfaces, and in such an instance, precipitating cations can effectively be added if desired to a common container for the substrate to be cleaned and the part of the aqueous liquid alkaline cleaning composition being treated.

An aqueous liquid alkaline cleaning composition used in a process according to this invention preferably is strongly alkaline; more particularly it preferably contains at least, with increasing preference in the order given, 1.0, 2.0, 3.0, 4.0, 5.0, 6.0, 7.0, 8.0, 9.0, 10.0, 11.0, 12.0, 13.0, 14.0, 15.0, 15.5, 16.0, or 16.5 grams of hydroxide ions per liter of aqueous liquid alkaline cleaning composition (this unit of concentration being hereinafter applied to any solute in any liquid phase and being usually abbreviated as "g/l") and independently preferably, primarily for reasons of economy, contains not more than, with increasing preference in the order given, 150, 100, 75, 50, 40, 35, 32, 29, 26, 23, 21, 19, or 17 g/l of hydroxide ions. Independently, the hydroxide ions are preferably provided to the aqueous liquid alkaline cleaning composition by dissolving therein one or more of the alkali metal hydroxides, with sodium and/or potassium being preferred primarily for reasons of economy. Most preferably, hydroxide ions are provided in an aqueous liquid alkaline cleaning composition used according to this invention by both sodium and potassium hydroxides, with a molar ratio of sodium to potassium that is at least, with increasing preference in the order given, 2:1.0, 4:1.0, 6:1.0, 8:1.0, 10:1.0, 12:1.0, 14:1.0, 16:1.0, 18.0:1.0, 19.0:1.0, 20.0:1.0, 21.0:1.0, or 21.5:1.0 and independently preferably is not more than, with increasing preference in the order given, 100:1.0, 90:1.0, 80:1.0, 70:1.0, 60:1.0, 55:1.0, 50:1.0, 45:1.0, 40:1.0, 35:1.0, 30:1.0, 28:1.0, 26:1.0, 24:1.0, or 22:1.0.

At least when an underlying conversion coating is to be removed along with metal intermediate length carboxylate salt(s) in a process according to this invention, the aqueous liquid alkaline cleaning composition preferably also contains a chelating agent for multivalent metal cations (i.e., metal cations with at least two positive electric charges).

Any chelating agent used is preferably selected from the group consisting of molecules each of which contains at least two moieties selected from the group consisting of carboxyl, carboxylate, non-carboxyl hydroxyl, amino, thio, phosphonic acid, phosphonate, phosphinic acid, and phosphinate moieties. More preferably, any chelating agent is selected from the group consisting of gluconic, citric, and malic acids, polymers of acrylic and mateic acids, and water soluble salts of all of these acids and polymers of acids, or still more preferably from gluconic acid and its salts, the latter being most preferably used in view of the independent preference for strongly alkaline aqueous liquid alkaline cleaning compositions. When highly preferred sodium gluconate is used in an aqueous liquid alkaline cleaning composition according to this invention, its concentration preferably is at least, with increasing preference in the order given, 0.7, 1.5, 2.0, 3.0, 4.0, 4.5, 5.0, 5.5, 6.0, 6.5, 7.0, or 7.5 g/l and independently preferably, primarily for reasons of economy, is not more than, with increasing preference in the order given, 50, 40, 30, 25, 20. 15, 12, 10, or 8 g/l. Further and independently, when sodium gluconate is used as the chelating agent, the ratio of its concentration to that of hydroxide ions preferably is at least, with increasing preference in the order given, 0.10:1.0, 0.20:1.0. 0.25:1.0, 0.30.1.0, 0.33:1.0, 0.36:1.0, 0.39:1.0, 0.42:1.0, or 0.45:1.0 and independently preferably is not more than, with increasing preference in the order given, 1.0:1.0, 0.80:1.0, 0.70:1.0, 0.65:1.0, 0.60:1.0, 0.55:1.0, 0.52:1.0, or 0.49:1.0. If some other chelating agent that consists of molecules each of which contains at least two moieties selected from the group consisting of carboxyl, carboxylate, non-carboxyl hydroxyl, amino, thio, phosphonic acid, phosphonate, phosphinic acid, and phosphinate moieties is used, either alone or in combination with sodium gluconate, these numerical preferences should be adjusted so as to provide the same numbers of molecules of substances each molecule of which contains at least two moieties selected from the group consisting of carboxyl, carboxylate, non-carboxyl hydroxyl, amino, thio, phosphonic acid, phosphonate, phosphinic acid, and phosphinate moieties as are provided by the numbers given above for sodium gluconate as the only such chelating agent, except that if polymeric chelating agents containing carbon chain "backbones" with pendant moieties selected from the group consisting of carboxyl, carboxylate, non-carboxyl hydroxyl, amino, thio, phosphonic acid, phosphonate, phosphinic acid, and phosphinate moieties are utilized, each successive segment of the polymer that contains two of these pendant moieties that are not part of any other segment of the polymer molecule is to be considered as a separate molecule for purposes of this calculation.

Ordinarily it is preferable for an aqueous liquid alkaline cleaning composition according to this invention to contain surfactant materials in addition to any chelating agent that it may contain. Nonionic and anionic surfactants are preferred over cationic ones for an aqueous liquid alkaline cleaning composition according to the invention, with a combination of ethoxylated alcohol or alkyl phenol nonionic surfactant and salts, most preferably mono-amine salts, of aromatic-moiety-containing partial esters of phosphoric acid being most preferred. This mixture is conveniently provided by a commercial product, KRITCHEM™ 1248M surfactant obtained from Kritchem, Inc. of Tucson, Ariz. and reported by its supplier to contain a total of 82% of its active ingredients, which are monoethanol amine, aromatic phosphate ester(s) surfactant with a CAS Registry Number of 39464-70-5, and nonionic surfactant with a CAS Registry Number of 68131-408. These types of surfactants are also available separately from other sources and may be used alone or in mixtures with each other and, optionally, an amine such as monoethanol amine to neutralize any anionic surfactant present.

Irrespective of its exact chemical nature, the concentration of surfactant, exclusive of any that may be part of a chelating agent component as described above, in an aqueous liquid alkaline cleaning composition according to this invention preferably is at least, with increasing preference in the order given, 0.50, 1.0, 1.5, 2.0, 2.5, 3.0, 3.5, 4.0, 4.5, or 4.9 g/l and independently preferably, primarily for reasons of economy, is not more than 50, 40, 30, 20, 15, 10, 8, or 6 g/l.

An aqueous liquid alkaline cleaning composition used according to the invention may of course optionally contain other constituents. For example, if post-rusting of the cleaned article is observed, a corrosion inhibitor distinct from any of the other constituents considered above may be advantageous as a constituent of the cleaner. A very wide variety of substances suitable for this purpose are known to those skilled in the art, and can be added to any rinse water used in optional step (IV") instead of or in addition to the aqueous liquid alkaline cleaning composition itself.

Rather small concentrations of intermediate length carboxylate anions are capable of greatly enhancing foaming, particularly when an aqueous liquid alkaline cleaning composition is sprayed onto the substrate article to be cleaned, as is usually preferred, and/or when the aqueous liquid alkaline cleaning composition is continuously circulated through a holding tank into or out of which a substantial flow rate is maintained, causing the surface at the top of the liquid layer in the holding tank to be continuously mechanically disturbed and thereby to incorporate air that can sustain foam bubbles. It is therefore preferred in a process according to the invention that step (II) as defined above be discontinued for any particular volume of aqueous liquid alkaline cleaning composition as soon as the concentration of intermediate length carboxylate anions in the specified volume of aqueous liquid alkaline cleaning composition has been determined to exceed, with decreasing preference in the order given, 0.05, 0.10, 0.15, 0.20, 0.25, 0.30, 0.35, 0.40, 0.45, 0.50, 0.55, 0.60, 0.65, 0.70, or 0.75 g/l. Analogously but independently, in step (III) of a process according to the invention as described above, it is preferable to use a sufficient amount of precipitating cations to cause the concentration of intermediate length carboxylate anions in the regenerated aqueous liquid alkaline cleaning composition at the end of step (III) not to exceed, with increasing preference in the order given, 0.50, 0.45, 0.40, 0.35, 0.30, 0.25, 0.20, 0.15, 0.10, 0.08, 0.06, 0.04, 0.02, 0.007, 0.004, or 0.001 g/l of intermediate length carboxylate anions.

Any chemical type of cations that reduce the concentration of intermediate length carboxylate anions at the end of process step (III) as described above below the upper limit desired for this constituent may be used in a process according to the invention, if the cations form a salt with a sufficiently large solubility in water to form an appropriate precipitating solution. (In principle, solid salts of the precipitating cations can also be added directly to the used aqueous liquid alkaline cleaning composition in step (III) of a process according to the invention as defined above. In practice, however, such a method is much less preferred, because the intermediate length carboxylate salt(s) of the most used precipitating cations have such low solubility in water that the surface of even a fine particle of a water soluble salt of a precipitating cation can become coated with a deposit of precipitated metal intermediate length carboxylate salt(s) that prevents the interior of the particle from dissolving and contributing its precipitating cations content to the precipitation process. Therefore, adding the precipitating cations in the form of a solution in water is almost always preferred in step (III).) Primarily for reasons of economy, calcium and magnesium precipitating cations are usually preferred, and their chloride and nitrate salts are preferred sources for these ions in a solution of the precipitating cations in water.

Surprisingly, in view of the low solubility of most divalent and trivalent metal intermediate length carboxylate salts in water, considerably more than a stoichiometric amount of precipitating cations is required to obtain the maximum amount of foam abatement in a process according to this invention. More specifically, even though divalent precipitating cations form salts with twice their molar amounts of intermediate length carboxylate anions, if it is desired to reduce foaming as much as possible, by the end of step (Ill) as described above in a process according to this invention, the molar ratio between {the amount of divalent precipitating cations added to the amount of used aqueous liquid alkaline cleaning composition being regenerated} and {the amount of intermediate length carboxylate anions present at the beginning of step (III) as described above in the used aqueous liquid alkaline cleaning composition being regenerated} preferably is at least, with increasing preference in the order given, 1.0:1.0, 2.0:1.0, 3.0:1.0, 4.0:1.0, 5.0:1.0, 6.0:1.0, 6.5:1.0, 7.0:1.0, 7.5:1.0, 8.0:1.0, 8.5:1.0, 9.0:1.0, 9.5:1.0, or 10.0:1.0. Independently and primarily for reasons of economy, this ratio preferably is not greater than, with increasing preference in the order given, 40:1.0, 30:1.0, 25:1.0, 20:1.0, or 15:1.0 and may of course be even less if foam abatement adequate for the particular use is thereby achieved.

During its use in cleaning in step (II) as described above of a process according to this invention and independently during formation of a precipitate in step (III) as described above of a process according to this invention, an aqueous liquid alkaline cleaning composition is preferably maintained at a temperature of at least, with increasing preference in the order given, 30, 40, 50, 60, 65, 70, 75, 80, or 84° C. and independently preferably, primarily for reasons of economy, is not more than, with increasing preference in the order given, 99, 97, 95, 93, 91, 89, or 87° C. If rinsing step (IV") is used as is normally preferred, the rinse liquid temperature during rinsing preferably should be high enough that the cleaned and rinsed article will spontaneously dry in the normal ambient natural atmosphere within a time of not more than, with increasing preference in the order given, 10, 8, 6, 4, 2.0, 1.0, 0.8, 0.6, or 0.4 minutes (hereinafter usually abbreviated as "min"). A rinsing temperature that is at least, with increasing preference in the order given, 45, 50, 52, 54, or 56° C. will generally be satisfactory to accomplish this purpose.

Contact between the substrate article to be cleaned and the aqueous liquid alkaline cleaning composition during cleaning step (II) as described above of a process according to the invention should be sufficient to accomplish the degree of cleaning desired. When substantially complete removal of the solid metal intermediate length carboxylate salt(s) and of a conversion coating of customary composition (usually zinc phosphate) and thickness (usually corresponding to at least several grams of conversion coating per square meter of substrate treated) from the substrate is desired, as is most usual in practice of this invention, the time of contact during cleaning preferably is at least, with increasing preference in the order given, 1.0, 1.5, 2.0, 2.5, 3.0, 3.5, or 4.0 min and independently, primarily for reasons of economy, preferably is not more than 20, 15, 12, 10, 8, 6, or 4.5 min. Independently and primarily for reasons of economy, precipitation step (III) as described above in a process according to this invention is preferably completed within a time interval not greater than, with increasing preference in the order given, 50, 40, 30, 20, 15, 10, 8, 6, 4, 2, 0.9, 0.5, or 0.3 min.

The practice of this invention may be further appreciated by consideration of the following, non-limiting, working examples, and the benefits of the invention may be further appreciated by reference to the comparison examples.

The following foaming test was used on a laboratory scale in the examples: A volume of 50 milliliters (hereinafter usually abbreviated as "ml") of an aqueous liquid alkaline cleaning composition is transferred to a capped graduated cylinder with 100 ml of graduated capacity and shaken vigorously by hand with the cylinder maintained vertical, ten times in rapid succession. The foam volume, measured, with the aid of the graduations on the cylinder, as the difference between the volume below the liquid meniscus and the volume below the top of the foam as soon as possible after completion of this shaking and again at 1.0 min after completing the shaking, was recorded.

In a pilot scale spray cleaning operation also used, foam height in a holding tank for the sprayed aqueous liquid alkaline cleaning composition was measured under constant operating conditions.

EXAMPLE AND COMPARISON EXAMPLE GROUP 1

Aqueous liquid alkaline cleaning Composition 1, containing, in addition to water, 75 g/l of a concentrate having the following ingredients in addition to water per thousand parts of total concentrate: 124 parts of hydroxide ions; 161 parts of sodium cations; 12.5 parts of potassium cations; and 37 parts of KRITCHEM™ 1248M surfactant mixture, is used to clean zinc and sodium stearates from metal articles until it accumulates a concentration of 0.76 g/l of stearate ions. At a temperature of about 70° C., this used aqueous liquid alkaline cleaning composition has a foam volume, measured by the laboratory test described above, that is greater than 50 ml both immediately and one minute after shaking. Calcium chloride, in the form of an aqueous solution containing 23.6% of $CaCl_2$, is then added to this used aqueous liquid alkaline cleaning composition in successive amounts so as to result in concentrations of 0.5, 1.0, and 5.0 g/l of calcium chloride. The resulting solutions have foam volumes in the same test as shown in Table 1 below.

TABLE 1

FOAM VOLUMES FOR GROUP 1

| Concentration of $CaCl_2$, g/l | Ratio, (Moles of $Ca^{+2}$): (Moles of Stearate) | Foam Volume, ml | |
|---|---|---|---|
| | | Immediately after Shaking | 1.0 Min After Shaking |
| 0.5 | 0.37:1.0 | >50 | >50 |
| 1.0 | 0.74:1.0 | 35 | 18 |
| 5.0 | 3.70:1.0 | 15 | 8 |

EXAMPLE AND COMPARISON EXAMPLE GROUP 2

Aqueous liquid alkaline cleaning Composition 2, containing, in addition to water, 100 g/l of a concentrate having the following ingredients in addition to water per thousand parts of total concentrate: 124 parts of hydroxide ions; 161 parts of sodium cations; 12.5 parts of potassium cations; 57 parts of sodium gluconate; and 37 parts of KRITCHEM™ 1248M surfactant mixture, is used at a temperature of 85±2° C. to clean external zinc and sodium stearates from cold rolled steel articles with an intermediate conventional zinc phosphate conversion coating until the aqueous liquid alkaline cleaning composition accumulates a concentration of 0.17 g/l of stearate ions. At a temperature of 85±2° C., this aqueous liquid alkaline cleaning composition, before it is used, generates foam 12±3 millimeters (hereinafter usually abbreviated as "mm") in height in a holding tank when circulated through a pilot scale spray cleaning apparatus in the same manner as it would be used for cleaning. After using the aqueous liquid alkaline cleaning composition in cleaning zinc and sodium stearates from substrate articles to accumulate the concentration of dissolved stearate noted above, calcium nitrate, in the form of an aqueous solution containing 46.4% of $Ca(NO_3)_2$, was then added to this used aqueous liquid alkaline cleaning composition in successive amounts so as to result in calcium nitrate solution concentrations of 0.35 or 0.70 volume % in the cleaning composition. The used and partially or completely regenerated used aqueous liquid alkaline cleaning compositions thus produced generates foam heights in the same holding tank under the same mechanical conditions as shown in Table 2 below. The regenerated used aqueous liquid alkaline cleaning compositions cleaned as well as the freshly prepared solution, as judged by visual appearance of the cleaned articles after a hot water rinse for 1.0 minute at 57±3° C. and spontaneous drying thereafter.

TABLE 2

FOAM HEIGHTS FOR GROUP 2

| Concentration of Aqueous Solution of $Ca(NO_3)_2$, Volume Percent | Ratio, (Moles of $Ca^{+2}$): (Moles of Stearate) | Foam Height, mm |
|---|---|---|
| 0 | 0:1.0 | 120 to 150 |
| 0.35 | 5.37:1.0 | 12 to 25 |
| 0.7 | 10.7:1.0 | 12 ± 3 |

EXAMPLE GROUP 3

This was performed in the same manner as Group 2, except that only half as much of the same concentrate was used to prepare the aqueous liquid alkaline cleaning composition, and cleaning was continued only until 0.077 g/l of stearate ions had accumulated in the solution. A sufficient amount of the same calcium nitrate solution as used in Group 2 was added to the thus used aqueous liquid alkaline cleaning composition to give a concentration of 0.35 volume % of the calcium nitrate solution in the total mixture. After separation of the precipitated calcium stearate, the thus regenerated used aqueous liquid alkaline cleaning composition cleaned metal substrates as well as the more concentrated freshly prepared or regenerated used aqueous liquid alkaline cleaning compositions described in Group 2.

What is claimed is:

1. A process for reducing foaming of a cleaning composition for cleaning of metal intermediate length carboxylate salt(s) from a surface of a solid, water-resistant substrate, said process comprising the following operations:

(I) providing a volume of an aqueous, liquid, alkaline, cleaning composition for dissolving said metal intermediate length carboxylate salt(s);

(II) contacting the aqueous, liquid, alkaline, cleaning composition with the surface of the solid, water-resistant substrate to be cleaned to dissolve at least a part of said metal intermediate length carboxylate salt (s) from said surface of the solid, water-resistant substrate into said aqueous, liquid, alkaline, cleaning composition, thereby converting the aqueous, liquid, alkaline, cleaning composition to a used, aqueous, liquid, alkaline, cleaning composition and converting said surface of said solid, water-resistant substrate to a cleaned and at least initially wet surface of said solid, water-resistant substrate; and (III) reducing the foaming of said aqueous, liquid, alkaline, cleaning composition by adding to at least a part of said used, aqueous, liquid, alkaline, cleaning composition precipitating cations to cause, within a time of not more than one hour after said adding of the precipitating cations, a solid phase that comprises at least part of said precipitating cations and at least part of anions of the metal intermediate length carboxylate salt(s) dissolved in said used, aqueous, liquid, alkaline, cleaning composition to separate from said used, aqueous, liquid, alkaline, cleaning composition and form a regenerated, aqueous, liquid, alkaline, cleaning composition with reduced foaming tendencies.

2. The process according to claim 1, additionally comprising at least one of the following operations:

(IV') contacting the regenerated, aqueous, liquid, alkaline, cleaning composition that is provided in step (III) with a surface of a second solid, water-resistant substrate having metal, intermediate length, carboxylate salt(s) to dissolve at least a part of said metal, intermediate length, carboxylate salt(s) from said solid surface of the second water-resistant substrate into said regenerated, aqueous, liquid, alkaline, cleaning composition, thereby converting the regenerated, aqueous, liquid, alkaline, cleaning composition to a once re-used, aqueous, liquid, alkaline, cleaning composition: and (IV") rinsing from the cleaned surface provided at the end of step (II), any residue of said aqueous, liquid, alkaline, cleaning composition that remains in contact with the cleaned surface at the end of step (II) and drying the cleaned surface to provide a cleaned dry surface.

3. The process according to claim 1, wherein said aqueous, liquid, alkaline, cleaning composition further comprises dissolved hydroxide ions and a chelating agent.

4. The process of claim 1 wherein said aqueous, liquid, alkaline, cleaning composition comprises one or more chelating agents selected from the group consisting of gluconic acid, citric acid, malic acid, polymers of acrylic acid, polymers of maleic acid and water soluble salts thereof.

5. The process of claim 1 wherein said aqueous liquid, alkaline, cleaning composition comprises dissolved hydroxide ions.

6. The process of claim 1 wherein said aqueous, liquid, alkaline, cleaning composition comprises sodium hydroxide and potassium hydroxide.

7. The process of claim 1 wherein said precipitating cations are selected from the group consisting of calcium cations and magnesium cations.

8. The process of claim 1 wherein said solid, water-resistant substrate is comprised of metal.

9. The process of claim 1 wherein said solid, water-resistant substrate to be cleaned is comprised of metal and has a conversion coating on said surface of the solid, water-resistant substrate.

10. The process of claim 1 wherein said aqueous, liquid, alkaline, cleaning composition is comprised of both (i) at least one of ethoxylated alcohol and ethoxylated alkyl phenol nonionic surfactant and (ii) salts of aromatic-moiety-containing partial esters of phosphoric acid.

11. The process of claim 1 wherein an amount of said precipitating cations is added to said used, aqueous, liquid, alkaline, cleaning composition in step (III) which is in stoichiometric excess relative to the amount of said metal intermediate length carboxylate salt(s) in said used, aqueous, liquid, alkaline, cleaning composition.

12. The process according to claim 3, wherein the aqueous, liquid, alkaline, cleaning composition further comprises a surfactant containing both anionic and nonionic surfactant molecules.

* * * * *